United States Patent [19]

Eickmann

[11] 3,960,060

[45] *June 1, 1976

[54] PRESSURE RESPONSIVE CONTROL BODY ARRANGEMENT

[76] Inventor: Karl Eickmann, 2420 Isshiki, Hayama, Kanagawa, Japan

[ * ] Notice: The portion of the term of this patent subsequent to Aug. 27, 1991, has been disclaimed.

[22] Filed: July 10, 1974

[21] Appl. No.: 487,271

Related U.S. Application Data

[63] Continuation-in-part of Ser. No. 239,551, March 30, 1972, Pat. No. 3,831,496.

[30] Foreign Application Priority Data

Apr. 7, 1971 Austria ..... 2987/71

[52] U.S. Cl. ..... 91/487

[51] Int. Cl.[2] ..... F01B 1/00

[58] Field of Search..... 91/487, 486, 485

[56] References Cited

UNITED STATES PATENTS

| | | | |
|---|---|---|---|
| 3,831,496 | 8/1974 | Eickmann | 91/487 |
| 3,850,201 | 11/1974 | Eickmann | 91/487 |

*Primary Examiner*—William L. Freeh
*Assistant Examiner*—G. P. La Pointe
*Attorney, Agent, or Firm*—Michael J. Striker

[57] ABSTRACT

A pressure responsive control body in the housing of a fluid handling device has a control face which abuts against the control face at one axial end of a rotor which is provided with working chambers for the inflow and expulsion of a fluid. A portion of the control body extends into a pressure chamber of the housing and the control body is movable axially of the housing. The control body seals a portion of the pressure chamber by means of an eccentrically located cylindrical shoulder a portion of which extends radially beyond the control face. This insures that the position of the pressure center of the eccentric shoulder relative to the axis of the rotor is the same as the position of the pressure center between the control faces. Such positioning of the pressure centers guarantees a smooth running of the control face on the rotor relative to the control face on the control body and prevents relative tilting or adherence of the control faces to each other so that the control mirror between the control faces operates with a high degree of efficiency even at high fluid pressures and at a high RPM of the rotor.

10 Claims, 9 Drawing Figures

Fig. 4
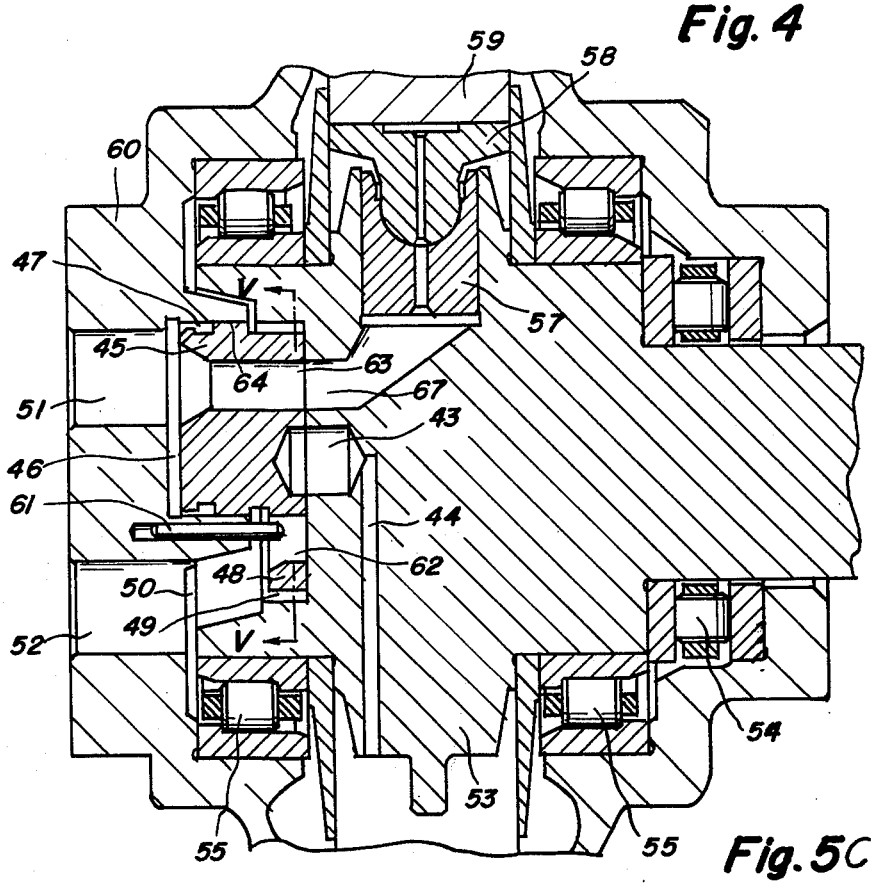
Fig. 5C
Fig. 5A
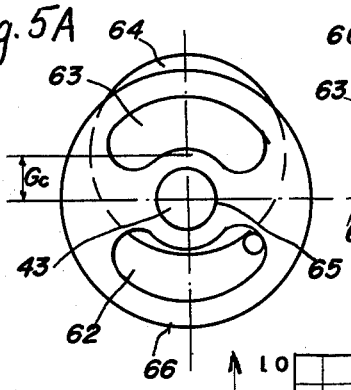
Fig. 5B
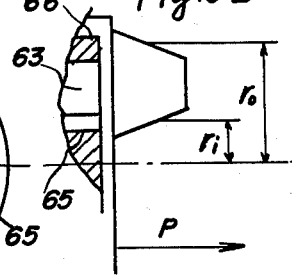
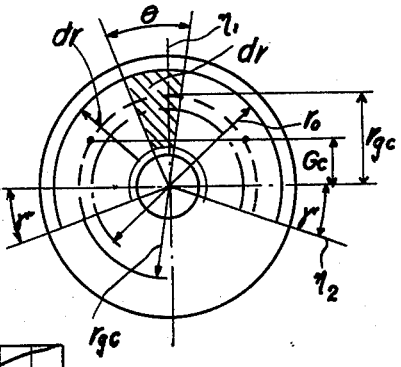
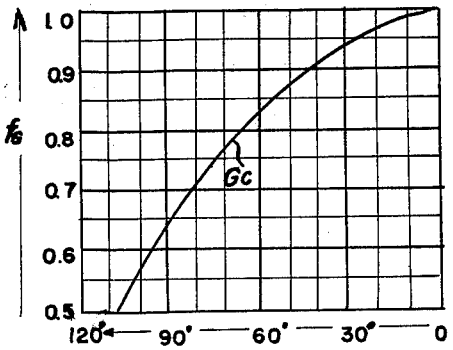
FIG. 5D

PRESSURE RESPONSIVE CONTROL BODY ARRANGEMENT

This is a continuation in part of my U.S. Pat. application Ser. No. 239,551 of Mar. 30, 1972 now U.S. Pat. No. 3,831,496.

BACKGROUND OF THE INVENTION

The present invention relates to a pressure responsive control body arrangement in a fluid handling device, such as a hydraulic or pneumatic pump, compressor, motor, engine, transmission or the like having working chambers associated with displacement members serving to induce the flow of a fluid into and out of the working chambers. Rotary fluid handling devices of such type are disclosed in my U.S. Pat. No. 3,561,328. Known fluid handling devices exhibit the drawback that the structure is not compact enough, that the production costs are too high and manufacturing times too long, and that the efficiency is too low.

The fluid handling device of my aforementioned patent exhibits the additional drawback that an opposition chamber must be provided at higher fluid pressures or at higher relative velocities between the stationary and rotary control faces in order to counteract excessive localized pressure forces which urge portions of the rotary and stationary control faces against each other.

SUMMARY OF THE INVENTION

It is an object of the invention to provide a fluid handling device for substantially axial flow of fluid which overcomes the drawbacks of known fluid handling devices and wherein the control body is of extremely simple design, easy to manufacture, capable of being machined with a high degree of accuracy, and capable of controlling the flow of fluid into and out of the rotor with reduced friction and reduced leakage of fluid and with a high degree of efficiency during high- or low-pressure as well as during high- or low velocity operation.

Another object of the invention is to provide a fluid handling device which dispenses with the conventional opposition chamber on a shoulder of the control body and which can also dispense with connections for and control arrangements associated with the opposition chamber.

A further object of the invention is to eliminate the expensive oposition chamber and the parts associated therewith without removing the reliability of the pressure-responsive control body of the fluid handling device.

My aforementioned patent discloses that conventional control bodies for controlling the flow of fluid into and out of the rotor of a fluid handling device have a relatively long useful life at certain pressures and relative velocities between the control faces, but that such control bodies are often difficult to produce with sufficient accuracy so that they fail to meet the requirements with satisfactory efficiency and reliability. Therefore, it is necessary to improve the configuration of the control bodies by providing them with an eccentric portion and an opposition chamber, together with associated control members, whenever the rotor of the fluid handling device is to operate at a higher speed or when the device is to operate at a higher pressure. When the opposition chamber is not associated with the eccentric shoulder of the control body which is disclosed in my patent No. 3,561,328, the stationary control face of the control body is pressed against the rotary control face of the rotor with an excessive localized force so that, as soon as a certain pressure is exceeded, the control faces tend to adhere and to be welded to each other. Such drawback can be overcome by providing the opposition chamber when the patented device is used at an elevated pressure of fluid. However, the opposition chamber takes up additional space and its provision entails further expenditures in time and expenses for additional members such as a flow control piston, passages and others, so that, even though the opposition chamber renders the control body more effective, it contributes to the cost and space requirements of the device. In addition, it has been found that the opposition chamber in the fluid handling device of my Patent No. 3,561,328 necessitates the provision of sealing means which reduce the mobility of the control body; this, in turn, limits the control body to use at elevated pressures. If the opposition chamber is omitted, the control faces bend to adhere and to be welded to each other at median fluid pressures and at median velocities of the rotor.

It has now been found, in accordance with the present invention that the welding control faces in the device of my U.S. Pat. No. 3,561,328 in the absence if an opposition chamber is due to excessive closeness if the center of the shoulder of the control body to the axis of the device which gives rise to excessive localized pressure in the control clearance. The opposition chamber prevents such welding, but its provision necessitates an increase of the diameter of the shoulder on the control body and expensive additions.

It has further been found in accordance with the present invention that the device can be greatly simplified and effectively improved for practical construction and operation if a. the diameter of the shoulder of the control body is reduced, together with b. the placing of the pressure center of the fluid pressure chamber into which the shoulder of the control body extends at a greater radial distance from the axis of the rotor so as to be located at the same distance from such axis as the pressure center in the fluid between the stationary and rotary control faces.

It has further been found in accordance with the invention that a single seal is needed in association with the fluid containing pressure chamber and the control body with an eccentric portion if the eccentric shoulder is correctly dimensioned and located in a fluid handling device for uni-directional flow of fluid therein.

In accordance with the above discoveries, the fluid handling device can be improved in accordance with the invention 1. by providing the control body with a shoulder of cylindrical shape but located eccentrically with respect to the axis of the rotor to such an extent that, even when the shoulder is small, a portion thereof extends radially beyond the stationary control face of the control body or radially beyond the rotary control face of the rotor; or 2. in a device for unidirectional flow of fluid, the control body may have a single concentric portion and a single eccentric portion whereby one of these portions may remain unsealed; or 3. the member which is provided with the fluidcontaining pressure chambers and receives a portion of the control body may be assembled of two parts so that the eccentric shoulder of the control body may be inserted between the two parts; or 4. the diameter of the end portion of the control body can be reduced to a small value in order to render it possible that the eccentric shoulder extends radially beyond the control faces; or 5. the rotor passages are inclined radially inwardly from the bottoms of the working chambers in order to port at the smallest possible distance from the axis of the rotor through the respective axial end of the rotor so as to allow for a reduction of the diameter of the control body and for extension of the control shoulder radially beyond the control face even if the diameter of the control shoulder is small. If the diameter of the control shoulder were too large, the control body would again require the opposition chamber of my U.S. Pat. No. 3,561,328 which the present invention aims to avoid.

Each control body of the invention exhibits the feature that a portion of the eccentric shoulder extends radially beyond the control face.

A feature common to all embodiments of the invention is also that the pressure center of the eccentric shoulder lies behind the pressure center of the control face.

Another feature common to all embodiments of the invention is that the cross section of the respective pressure chamber is only a few percent larger than the cross section of the corresponding high pressure equivalent area in the control clearance between the control body and the rotor.

The modifications of the invention include:

providing the fluid-containing pressure chamber in a one-piece body or in a body which is assembled of a plurality of parts;

providing a fluid-containing pressure chamber with one or two sealed portions; or employing a control body with a single eccentric portion and a single concentric portion or with a single eccentric portion and two concentric portions; or providing the control body with fluid passages which extend therethrough, with control ports which extend into the control body, or only with balancing ports.

The novel features which are considered as characteristic of the invention are set forth in particular in the appended claims. The fluid handling device itself, however, both as to its construction and its mode of operation, together with additional features and advantages thereof, will be best understood upon perusal of the following description of certain specific embodiments with reference to the accompanying drawing.

BRIEF DESCRIPTION OF THE DRAWING:

FIG. 4 is another similar sectional view as in FIG. 2 but of another modified device; and FIG. 5A is a diagrammatic section on line V—V of FIG. 4;

FIG. 5B is a fragmentary sectional detail of FIG. 4;

FIG. 5C is an explanatory diagram; and

FIG. 5D an explanatory graph.

DESCRIPTION OF THE PREFERRED EMBODIMENTS

Figure 1:
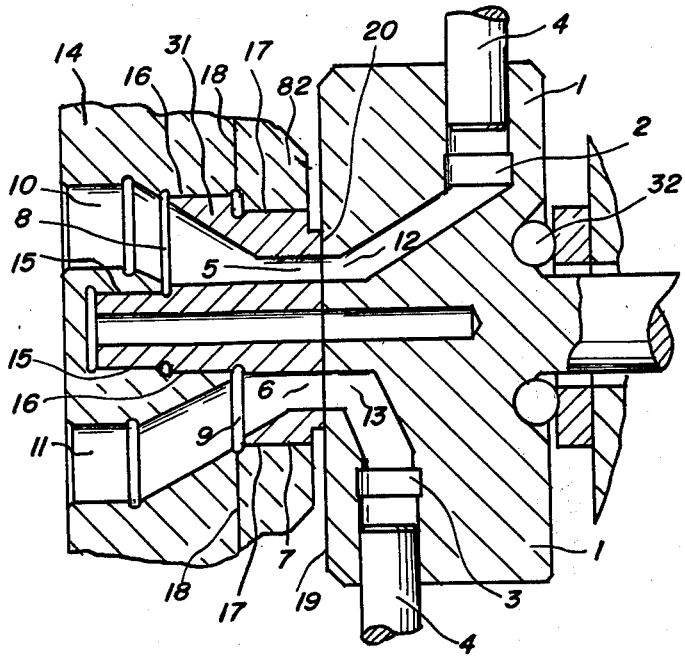
FIG. 1 is a fragmentary longitudinal sectional view of a fluid-handling device which embodies one form of the invention.

Referring to FIG. 1, a rotor 1 is rotatable in bearings provided therefor in a housing which is not fully shown in the drawing. The bearings include a thrust bearing 32 at one axial end of the rotor 1. The rotor 1 contains two or more fluid handling working chambers, for example, the chambers 2 and 3, and associated displacement members 4 which serve to effect an increase or a reduction of the volume of the respective working chambers. Rotor passages 12 and 13 extend from the respective working chambers 2 and 3 to an end of the rotor 1 and therethrough to form rotor ports which serve to convey fluid into and out of the working chambers. A housing portion or cover 14 of the device is provided with a fluid containing pressure chamber 8–9, and a control body 7 (also called thrust member or control chuck is partially received in the pressure chamber 8–9 and comprises a stationary control face 20 located at that end of the control body which is adjacent to the rotor 1 to slidingly and sealingly engage a rotary control face 19 at the adjacent axial end of the rotor. The fluid in the pressure chamber 8–9 urges the control body 7 axially against the control face 19 of the rotor 1 so that no leakage occurs or only a small quantity of fluid escapes through the control clearance which is formed between the control faces 19 and 20.

The control body 7 has one or more concentric portions (such as the portion 7*a* or the portions 7*a* and 15*a*) and at least one eccentric portion or shoulder 31. Fluid flows from a port 10 of the housing portion 14, through a combined passage and port 5 of the control body 7, through the rotor passage 12 or 13 into the respective working chamber 2 or 3 of the rotor 1, and out of the working chamber through the respective rotor passage 12 or 13, a combined control port and passage 6 of the control body 7, and a port 11 of the housing portion 14, or vice versa.

The heretofore described parts of the fluid handling device are known in the art, for example, from my patent No. 3,561,328.

However, the device of my patent No. 3,561,328 comprises an opposition chamber which is provided in the control body to oppose the fluid forces acting upon the control body in a direction toward the rotor. The opposition chamber is necessary because the control body of the patented device has a large-diameter rear end portion. This necessitates the provision of a large-diameter eccentric shoulder on the control body; on the other hand, the large-diameter of the end portion of the control body limits the eccentricity of the shoulder. Consequently, the diameter of the eccentric portion of the control body (together with the seals for the pressure chamber) is so large that the control body is pressed against portions of the control face on the rotor with an excessive force which renders it necessary to provide the aforementioned opposition chamber.

The expensive opposition chamber of the patented device can be dispensed with in accordance with the present invention which provides that a portion of the eccentric shoulder 31 of the control body 7 extend radially beyond the control face 19 or 20.

This feature of the invention renders it possible to eliminate the heretofore used counterbalancing center of the fluid containing pressure chamber portion and of the eccentric shoulder 31 of the control body 7 can be placed exactly into the same position relative to the rotor axis as the pressure center of fluid forming the film between the stationary and rotary control faces 20 and 19 only if the shoulder 31 extends in part radially beyond a control face. A uniform pressure of the control body 7 against the rotor 1, without excessive localized pressure, can be achieved only if both pressure centers have the same axis which is parallel to the axis of the rotor. The positioning of the pressure center of the eccentric shoulder 31 of the control body 7 in accordance with the invention, i.e., that the eccentric shoulder 31 extends in part radially beyond the control face 19 or 20, renders it possible to reduce the cross-sectional area of the eccentric shoulder or the pressure chamber portion 8 or 9 in such a way that the cross-sectional area exceeds only by a few percent the cross-sectional area of the associated portion of the fluid film in the control clearance between the control faces 19 and 20. The associated portion of the fluid film is considered to be the high-pressure equivalent area within the control clearance between the stationary and rotary control faces 20 and 19. This equivalent area consists actually of a high pressure area plus an area of pressure drop which latter has a lower fluid pressure but is considered to constitute a smaller area of high pressure, also called the high pressure equivalent area. In the device of my U.S. Pat. No. 3,561,328, the eccentric shoulder also extends beyond the control face; however, the cross-sectional area of the eccentric shouler is substantially larger than the associated pressure equivalent area in the control clearance. This necessitates the provision of the opposition chamber. In accordance with the invention, the opposition chamber can be omitted because the feature that the eccentric shoulder extends beyond the control face 20 is combined with a reduction of the cross-sectional area of the eccentric shoulder so that it exceeds only by a few percent the pressure equivalent area in the control clearance between the control faces 19 and 20.

Figure 2:
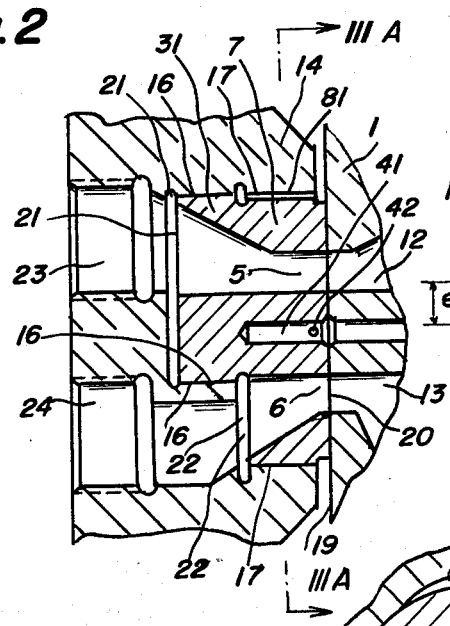
FIG. 2 is a similar sectional view of a modified device.

A simplified embodiment of the invention is shown in FIGS. 2 and 2*a*. Fluid flows from a port 24 of the housing portion 14, through a fluid containing suction chamber or intake chamber 22, through a combined passage and control port 6 and the respective rotor passage 13 or 12 into the corresponding working chamber of the rotor 1, and thereupon leaves the corresponding working chamber through the respective rotor passage 13 or 12 and the control clearance between the control faces 19, 20 into and through the combined control port and passage 5 and a pressure chamber 21 into and through an exit port 23 of the housing portion 14. The direction of fluid flow can be reversed.

If the direction of fluid flow in the fluid handling device is non-reversible, in certain cases the seal and seat 17 for the concentric portion 7*a* (FIG. 1) of the control body 7 can be omitted.

The composite fluid containing pressure chamber 21–22 of FIG. 2 consists of the pressure chambers 21 and 22. The chambers 21 and 22 are separated and sealed from each other by a seat 16 which is preferably cylindrical. The axis of the seat 16 is eccentric (see *e* in FIG. 2) relative to the axis of the rotor 1 and the axis of the concentric portion or portions of the control body 7. The fluid pressure chamber 22 may further be sealed by a seat 17 which is preferably cylindrical. However, the axis of the seat 17 coincides with the axis of the concentric portion or portions of the control body 7 and hence with the axis of the rotor 1. Fluid at high pressure can be present in the pressure chamber 21 or 22; in each instance, the pressure of fluid in the respective chamber 21 or 22 will urge the control body 7 axially against the control face 19 of the rotor 1 so that the control faces 19, 20 are pressed against each other and form a self-sealing clearance. The control body 7 is movable axially within limits in the pressure chamber 21– 22. In accordance with the invention, the cross sectional area of the eccentric portion or shouler 31 of the control body 7 should exceed only by a few percent (e.g. by 4–6 percent) the cross-sectional area of the respective high pressure equivalent area in the corresponding portion of the clearance between the control faces 19 and 20. Also, the eccentricity *e* of the eccentric shoulder 31 should be such that the pressure center of the shoulder 31 is coaxial with the pressure center of the corresponding portion of the control clearance between the control faces 19 and 20. The common axis of these pressure centers should be spaced from but parallel with the axis of the rotor 1.

If the above conditions are met, the device operates effectively at high and very high pressures as well as at high and very high relative velocities between the control faces 19 and 20. Thus, the eccentric shoulder 31 of the control body 7 must extend partially beyond the control face 20 and no opposition chamber need be provided at the opposite end of the eccentric shoulder 31.

If the flow of fluid in the device of FIG. 2 is always such that the fluid enters by way of the port 24 at a low pressure and leaves through the port 23 at a high pressure, the fluid containing pressure chamber 21 is always the high pressure chamber and the chamber 22 is always the low pressure chamber. Sometimes, the low pressure chamber requires no seal or merely requires a rough seal. The machining of the control body 7 and of the associated seats in the housing is simplified if no seal is required for the low pressure chamber 22. In such instance, only the cylindrical eccentric seat 16 must be machined with precision. The housing portion 14 can be cast or pressed with substantial tolerance, and the same applies for the outer diameter of the concentric portion or portions of the control body 7. In fact, the concentric portion of the control body 7 can be received in the housing portion 14 with substantial clearance so that the control body actually floats in the housing portion within certain limits. The machining of the seat 16 and eccentric shoulder 31 is then very simple and inexpensive, and no special care must be exercised regarding the location of the concentric portion of the control body 7 relative to the housing portion 14. The convenience of manufacture is in addition to a more reliable and more effective operation of the control body.

In fluid handling devices with reversal of pressure or of direction of fluid flow, it is often necessary or desired to have a small portion of a shaft extend axially through the entire device. It is then necessary to provide in the housing portion 14 a seat 15 (FIG. 1) for the rear end portion 15a of the control body 7. The rear end portion 15a of the control body 7 in the seat 15 must be sealed from the fluid pressure chamber 8 because, otherwise, a portion of the shaft could not extend through the rear end of the device without leakage of fluid from the chamber 8. The seat 15 in the housing portion 14 is concentric with the rotor 1. Each of the seats 15, 16 and 17 is preferably cylindrical. The embodiment of FIG. 1 is employed mainly for reversible flow and reversing of the high pressure chambers 8 and 9. Therefore, in the device of FIG. 1, all of the seats 15, 16 and 17 are sealed. The sealing is normally effected by providing diametrical clearances in the range of 50 thousandths of a millimeter and by resorting to plastic or expanding ring type seals. The ports 10 and 11 of FIG. 1 are analogous to the ports 23 and 24 of FIG. 2., and the pressure chambers 8, 9 of FIG. 1 perform the functions of the chambers 21 and 22 shown in FIG. 2. All such parts shown in FIG. 2 which are identical with or analogous to the corresponding parts of the device shown in FIG. 1 are denoted by similar reference characters.

Since the eccentric shoulder 31 extends in part radially beyond the control face 20 of the control body 7, and since the seat 17 should also seal (as it must), it is necessary to divide the housing portion 14 of a device of the flow reversing type along the face 18 or along a face which is parallel to the face 18 to thereby facilitate the machining of the housing portion 14 and to allow for insertion of the control body 7. After such division and insertion of the control body 7 into its seats, the housing portion 14 must be assembled again and sealed along the face 18. The control body 7 remains movable in the axial direction of the housing portion 14 and is sealed within seats 15, 16 and 17 if the device is assembled in accordance with the present invention. The heretofore discussed matter is mainly contained in my aforementioned prior application. However, the said application fails to point out the novel matter of the present continuation-in-part application, which will now be discussed in detail.

It is generally known from former art to provide a thrust member with one concentric cylindrical seat and with one cylindrical seat that is eccentric thereto, for example, from the U.S. Patent 3,092,036. However, such thrust members needed balancing recesses in the control face of the thrust member, because they tended to tilt without such balancing recesses and that resulted in leakage at one portion of the control face and in friction or sticking at another local portion of the control face.

FIG. 2 of the invention now prevents such local leakage and sticking without the need for balancing recesses in the control face. That is achieved according to this invention in that a medial recess is provided in the thrust member and that said recess is communicated to a space under low pressure. FIG. 2 has a medial recess 41, and a an unloading bore 42, which connects the medial recess 41 through the trust member or any other suitable means to a space under low or no pressure such as, for example, with the interior of the housing of the pump or motor, which is commonly under no or low pressure. If the pump or motor is for one-directional rotation only the medial recess 41 may also be connected to the low pressure port of the device.

The above provision assure that the medial portion of the control face is under low pressure or under no pressure. Thereby the fluid pressure forces in the control face are radially inwards restricted by the novel medial recess in the control face.

Due to this restriction in accordance with the invention it becomes possible to dimension the cylindrical seat, the concentric seat so, that the thrust force out of the pressure chamber behind is only somewhat stronger than the force of fluid in the control clearance between the thrust member and the rotor. For this purpose the outer diameter of the concentric position of the thrust member and the diameter of the eccentric portion of the thrust member are so dimensioned, that the pressure area between them ist pressed against the rotor with just of such size, that the thrust member ist just with the desired force. The diameter of the eccentric portion of the thrust member is also just so selected, that the cross-sectional area therethrough is of such size, that the thrust member in case of high pressure behind the eccentric portion again is pressed against the rotor with just such force as is desired. The diameter of the novel medial recess is so dimensioned, that it fits to the above mentioned dimensions of the thrust member. Further, in order to make the thrust member of FIG. 2 applicable for both rotary directions of the rotor, it is necessary in accordance with this invention to select the eccentric distance of the axis through the eccentric portion of the thrust member just so, that the thrust member is at all times and at both rotary directions of the rotor pressed against the rotor so, that no tilting tendency or inclination tendency of the thrust member appears. The said eccentric distance is an important object of this invention. Because, if the said distance is not correctly dimensioned, the thrust member will incline or tilt and cause friction and leakage of the control clearance between thrust member and rotor and would thereby reduce the efficiency and power of the device.

Further, in FIG. 4 a fluid handling device, preferably a pump, compressor or motor for a single direction of rotation of the rotor, is shown.

In this case the housing or cover has only one single chamber 46 wherein the thrust member is sealingly located with its portion 45. The thrust member can axially move within said chamber 46. It is sealed within said chamber 46 either by fit or by a plastic sealing means 47. The chamber 46 is a fluid pressure chamber and communicated with the fluid port 51 for the power fluid of the device. Further, the chamber 46 is eccentrically located to the axis of the rotor and, this is important, the distance of the medial centre of the said chamber 46 and thereby of portion 45 of the thrust member from the axis of the rotor is so dimensioned, that the thrust member has no tendency to tilt or to incline. To define this distance is not possible without a definite mathematical analysis, which will be explained later. The thrust member again, as in FIG. 2, has a medial recess 43 and an unloading recess or bore 44. In FIG. 4 this extends through the rotor 53, wherefore rotor 53 is in communication with the said medial recess 43. The medial recess 43 may either be in the thrust member or in the adjacent rotor end, or in both. However, again the area in cross section through said medial recess must be so dimensioned that it fits to the crossectional area through portion 45 and chamber 46. Because otherwise the desired suitable axial thrust force of the thrust member against the rotor 53 cannot be obtained. It would become either too big or too small or the said inclination or tilt of the thrust member would appear. The only one sealed thrust chamber 46 of FIG. 4 is enough for a one-directional revolving fluid handling device. The second heretofore used thrust chamber is omitted by this invention.

Rotor 53 is revolvingly borne in bearings 55 in housing 60 and in axial direction rotor 53 is retained by the thrust bearing 54, whereas the rotor 53 revolves. Cylinders or chambers 56 are the fluid handling chambers which take the fluid in and expell it. Displacement means 57 for example pistons, are associated with chambers 56. Actuator means 59 are associated with the displacement means 57. Intermediate members 58, for example piston shoes, may be inserted between the displacement means 57 and the actuator means 59. If the device fullfills these conditions, as heretofore described the device will operate highly effectively and with great power in one rotational direction. It must, however, have a means for preventing the thrust member from rotation. This is either a second seat, as element 17 in FIG. 2, or a rotation prevention means, for example, element 61 in FIG. 4. In FIG. 4 this is a simple pin 61 which engages at the correct location into a respective recess 62 in the thrust member. Recess 62 may at the same time be the low pressure control port of the thrust member, while port 63 is the power fluid or higher pressure control port of the thrust member.

After the desired structures and functions of the novel thrust member have been learned from the above, it will now hereafter be analyzed how they can be achieved for practical application.

For this purpose we analyze firstly the appearances in the control face between the thrust member and the rotor.

The left one of FIG. 5A shows the control face of the thrust member in a view upon it from the rotor end. We recognize the medial recess 43 of the invention in the middle of the figure. The inner diameter of the conrol face is equal to the outer diameter of the medial recess 43 and identified by numeral 65. Radially outwards from the inner diameter 65 extends the control face, not referenced, up to the outer diameter 66 of the said control face. All therebetween is the stationary control face of the thrust member. Within this control face we recognize the high pressure or working fluid control port 63 and diametrically oppositely located we see the low pressure or no pressure control port 62. Since the latter and its surrounding area of the control face is of neglectible small pressure, we eliminate this port 62 and its surrounding from further consideration. Consequently we consider hereafter only the important working fluid or high pressure or power control port 63 and its surrounding area. The area of the port 63 is filled with high pressure fluid. This is recognized in the medial figure of FIG. 5B over the pressure axis *p*. Between the inner diameter 65 and the port 63 the pressure increases from small or no pressure to the high pressure in port 63. And from the outer diameter 66 the pressure increases again from no or low pressure to the high pressure in the port 63. This increase in pressure is also shown over *p* in the medial figure of FIG. 5B. The pressure gradient in these areas is shown as a straight line, in order to simplify understanding, but actually the pressure gradient are curves depending on the viscosity of the fluid, depending on relative velocity between the stationary control face of the thrust member and the rotary control face of the rotor, and upon several other factors. For the calculation which we will do, we neglect the curve and assume the straight line pressure gradient. We then obtain a medial radius "ri" between the inner diameter 65 and the port 63 and also a medial radius "ro" between the port 63 and the outer diameter 66. Persons, who are equainted with the curved configuration of the pressure gradients in these areas will correct the location of ro and ri accordingly or by empirical test. Under these considerations we can replace the inclined lines in FIG. 5B by vertical lines, parallel to the axis of *p* and obtain then an exactly rectangular pressure area on the high pressure *p* from ri to ro. Thereafter we will call this rectangular pressure area the High pressure aquivalent area $A_{HPm}$ of the control mirror or control clearance or of the control face. The above described assumptions are generally known from the art, except the name $A_{HPm}$ of the high pressure aquivalent area. As next step we are going to recognize that in many cases of application for example in most motors, the right half of FIG. 5A is symmetrical the left half. If it is unsymmetrical, as in some pumps, a correction may be made. For our further inquiries we look to FIG. 5C and recognize the left half of medial vertical line "eta 1" as symmetrical to the right half. Thereby we can eliminate the calculation of the left half and calculate only the right half.

Now we do our first recognition: This is, that the high pressure equivalent area does not extend over 90° only, but actually from zero angle of eta 1 towards an angle, greater than 90°, defined by the angle eta 2. This is the case, because the rotor passages revolve over the closing arc between the ports 63 and 62. Thereby the passages 67 are partially over the high pressure port 63 and partially over the said closing arc. Naturally thereby they pass high pressure fluid to the closing arc area and consequently the closing arc area between the ports 63 and 62 is partially and locally loaded with high pressure fluid. The size of the high pressure loaded area varies with each angle of rotation of the rotor. For our calculation we take a medial value thereof and call its angle, which exceeds 90° from eta 1 the angle gamma. Thereby the angle from eta until eta 2 becomes ninety degrees plus angle gamma. Our recognition now is, that the high pressure aquivalent area extends from eta 1 to eta 2 including the angle gamma. For the whole high pressure aquivalent area we so obtain the value Q and Q = 180° plus 2 gamma. Hereafter we introduce the value G which is: G = Q/360. The high pressure aquivalent area of the control face $A_{HPm}$ is now:

$$A_{HPm} = (ro^2 - r_i^2)\text{Pi G} \qquad 1)$$

In this equation (1) the values ro and ri play an important role and they must be defined as accurately as possible. An also very important value is G and its definition must be as accurate as possible, in order to obtain a perfectly functioning device. Our next step is to find the factor which is suitable to increase the crossectional area through chamber 46 so that the force of thrust of the thrust member against the rotor is the most advantageous accurate and effective operation and so that the leakage through the control clearance remains as small as possible and the friction in the control clearance betweenn the control faces remains also as small as possible. Depending upon the requirements of the designer, an almost zero leakage at low or medial pressure or a minimum of power loss at high pressure, the factor will be smaller or greater. The factor is called hereafter $f_b$ and is from experience and due to thousands of empirical tests known to be about $$f_b = \text{Balancing factor} = 1{,}04 \text{ to } 1{,}06 \qquad (2)$$

If designers use other values for ro; ri and gamma than set forth herein, the values of fb have to be corrected accordingly. There are some applications herein, fb is smaller or greater than in equation (2); but the value of equation (2) satisfies most requirements.

With the above basis we can now calculate the cross-sectional area through the pressure chamber 46 and call this area $A_{HPmb}$ or balancing area or thrust area and calculate it as follows:

$$A_{HPmb} = {}_{AHPm} \times f_b \quad (3)$$

The simplest machining of the pressure area $A_{hpmb}$ is to make the pressure chamber 46 of cylindrical configuration. The diameter of the cylindrical pressure chamber or thrust-chamber 46 can then be obtained by:

$$D = \text{diameter} = \sqrt{A_{HPmb}\ 4/\text{Pi}} \quad (4)$$

The diameter D of the thrust chamber 46 gives the desired suitable thrust to press the thrust body with the desired best thrust against the rotor. The balancing factor fb may therefore also be called: thrust factor. While the above equations are very accurate and novel it is assumed that others, who have utilised thrust members of the former art have also performed calculations of the needed thrust force. They may have obtained results, which might not be very far apart from the results to be obtained from the above equations.

However, by this invention it is mainly discovered and recognized, that the above calculations alone can not provide a suitable thrust member. Because if the eccentricity between the axis of the thrust chamber 46 and the axis of the rotor 53 is not exactly known and machined, the thrust member, even if it is built exactly according to the above equations, tends to tilt and incline and thereby to provide local wear at one portion of the control clearance and local leakage at another portion of the control face.

Therefore, the main inquiry of this invention is to find, if possible, an accurate value of the needed eccentricity *e* between said axes. Because, due to this invention, the thrust member can operate effectively at high rotary velocities and high pressures only; if the eccentricity *e* is exactly known and provided. If the eccentricity *e* can be obtained exactly and therafter be machined exactly, the thrust member will function not only properly at high and all other pressures and at high and all other rotary velocities, but also with highest efficiency, which means with the minimum of leackage and the minimum of friction between the adjacent control faces.

For this purpose in accordance with this invention the following inquiry is done by:

An interval tau is defined in FIG. 5C and the interval tau between ro and ri and the borders of angle tau is called dF or infinitesimal area dF. This definition is done, because it is assumed that the pressure centre of the control face is not in the middle between the radii ro and ri. The middle between the radii Ro and ri would be rm and easly be calculable by: Rm = (ro + ri)/2. But, since the area dF is wider at the radial outer portion than at the radial inner portion, the centre of it cannot be in the midst between ro and ri and therefore not on the medial radius rm. The radial distance between ro and ri is hereby defined as dr. We further introduce the gravity or pressure centre radius $rg_c$ whereon the pressure centre of the area dF will be located. To find $rg_c$ we calculate the integral mean value, which gives us the radius $r_{gc}$ by:

$$r_{gc} = \text{gravity centre radius} = \int r\ dF/F$$

And with dr = Rdr tau Pi/180 follows:

$$r_{gc} = \frac{\text{Tau Pi}}{180} \quad \frac{\int r^2\, dr}{F}$$

$$= \frac{\text{tau pi}}{180} \times \frac{r_o^3 - r_i^3}{3\ \text{Delta}\ F}$$

$$= \frac{360(r_o^3 - r_i^3)}{540(r_o^2 - r_i^2)}$$

or:

$$r_{gc} = \frac{2(r_o^3 - r_i^3)}{3(r_o^2 - r_i^2)} \quad (6)$$

The radius rgc whereon the pressure centre of the control face lies, is found by the above equation (6).

However, the radius rgc is not a value of an eccentricity ¥ *e*. But, in order to find the eccentricity *e* we will find the distance Gc of the gravity or pressure centre of the control face from the axis of the rotor. We can find this distance Gc by finding the integral medial value of the gravity centre radius rgc over the angular intervall from eta 1 to eta 2 graph of FIG. 5C. This is in an equation:

$$G_c = \int_{\eta_1}^{\eta_2} r_{gc}\ d\ \text{eta/eta 2} - \text{eta 1}$$

or:

$$G_c = \int_{\eta_1}^{\eta_2} \cos \text{eta}\ d\ \text{eta/eta 2} - \text{eta 1}$$

or:

$$G_c = r_{gc}\ (\sin \text{eta 2} - \sin \text{eta 1})/\text{eta 2} - \text{eta 1} \quad (7)$$

with eta in grade × pi/180. For delta eta = 90° $G_c$ becomes $G_c = r_{gc}(\sin \text{pi} - \sin \mathbf{0})/90\text{-}\ \mathbf{0}$ or: $G_{c(90°)} = r_{gc} \times$ 0,636.

For practical application we introduce the function $f_G$ for different angles and obtain thereby the graph of FIG. 5D which shows $G_c$ over different interval values of eta 2 minus eta 1.

And, therefrom we find very easily the gravity centre $G_c$ by:

$$G_c = r_{gc} \times f_G \quad (8)$$

with $f_G$ taken from the bottom graph of FIG. 5 for the respective value Q/2 = Difference eta 2 minus eta 1 of the control face. If the thrust member and pressure chamber are calculated by the above mentioned equations and then designed in accordance with the outcome of the calculations, sometimes - depending on the primary design data, which enter into the equations - the eccentric thrust chamber and the eccentric portion of the thrust member can no longer be retained within the outer diameter of the control face.

The thrust chamber 21 or 46 and the eccentric portion 31 or 45 of the thrust meber then extends by a small portion having the form of a moon sickle radially beyond the outer diameter of the control face. This small extending portion is identified by numeral 81 in FIG. 2 and by numeral 64 in FIGS. 4 and 5. For all cases of application, where this small portion extends beyond the outer diameter of the control face this extension in part is an important characteristics of the present invention.

Figure 3:
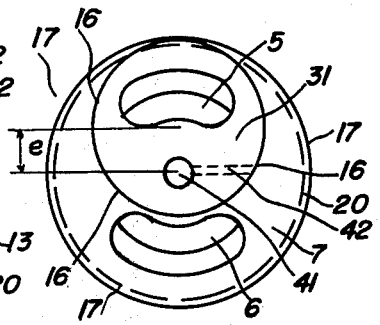
FIG. 3 is an end elevational view of the control body in the device of FIG. 2.
Figure 3A:
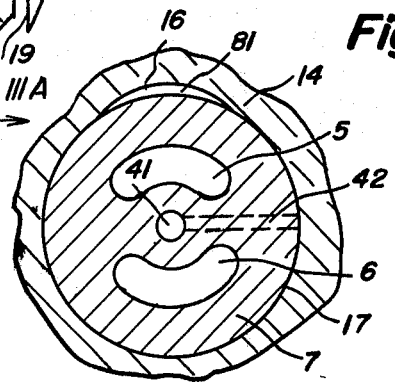
FIG. 3*a* is another end elevation view of FIG. 2.

This said partial extension of the thrust member makes it impossible to mount it into the housing or cover 14 or 60 if the thrust member and housing has a seat 17 as in FIG. 2. Therefore, in order to make the mounting of the thrust member into the housing or cover 14 or 60 possible, the seat 16 in the housing or cover 14 is extended through the seat 17 of the housing in FIG. 2. This forms a recess 81 in the form of a small moon sickle between the front portion 7 of the thrust member of FIG. 2 and the housing 14 of FIG. 2. In order to make this recess more clearly visible the cross-sectional FIG. 3A is added. By this provision the thrust member of FIG. 2 can now be easily moved axially into the housing 14 and the device can operate. However, the device of FIG. 2 can now operate only for a one directional rotating device, because the thrust chamber 22 must now be a low or no pressure chamber because fluid can escape out of it through the recess 81. If the device is provided for double directional rotation, then the housing must be divided into at least two parts, as in FIG. 1, and the part 81 must then be attached to the housing 14 after assembly of the thrust member. The seat 17 must then be circular and completely seal and enclose the cylindrical portion 7. This possibility of a division of the housing is not shown in FIG. 2, because it will be understood from FIG. 1 and its provision in FIG. 2 would render the other features of FIG. 2 too difficult to be understood.

In FIGS. 4 and 5 the cylindrical seat 7 of FIG. 2 is entirely eliminated, the housing 60 is thereby shortened in the direction towards the rotor and a space 49 appears around the cylindrical portion of the thrust member. The protection of the thrust member of FIGS. 4, 5 against rotation or pivoting is assured by the retainer pin 61, which is preferably fastend in the housing 60 and extends into a recess, e.g. port 62.

With the above provisions, the device including the thrust member and flow control will operate highly effectively at all desired relative speeds and pressures. For medial pressure ranges however, the following condition must be obeyed in accordance with this invention:

The centre line of the eccentric portions 31 and 45 of the thrust member and 21 and 46 of the fluid pressure thrust chamber must be distanced by the eccentricity *e* approximately in the size of the value Gc of the foregoing equations. Commonly the eccentricity lies in a plane normal to the plane through the inner and outer death point of the working chambers of the device. But sometimes, specially in case of higher pressure pumps, the eccentric plane might be a little inclined raltively to said normal plane. Mostly in rotary direction of the rotor. At motors the eccentre plane is commonly exactly normal to said plane through the said death points. For very high pressure devices in addition the following roole of the invention must be applied:

The centre line of the above mentioned portions must be exacly of the distance Gc. That means the eccentricity of the eccentric portion must equal the value: Gc of the respective equations.

The value of factor fb can define a leakage of only a few hundred cc/rev at high pressures of more than 1000 psi. But it can also define a leakage of about half a liter per minute at highest pressures of 3000 to 8000 psi. It can also define a power loss minimum, at which the sum of leak and friction is a minimum. In case of low pressure the leak can be almost completely eliminated in order to use the device as a flow meter measuring instrument. Generally with the thtust member of the invention, the leakage decreases a little with increase of rotary velocity.

Further, provided that suitable materials of the control faces are used, the device will reach its peak efficiency after a few hundred hours of high speed - high pressure running. Many tests show the said result. Therefore, if a customer gets a test record of a newly built fluid handling device of this invention with a total efficiency of 92 or 93 percent, he may expect, that after a few hundred hours of running at hight power, the device may increase its total efficiency to 94 or 96 percent.

It will be understood that, in order to provide a control body which bears axially against the rotor, it is necessary to incorporate the features of the invention. If the configuration of the control body or its mounting is changed only slightly, the control faces will be welded to each other or a substantial leakage of fluid will take place. Therefore, it is desirable to accurately follow the teaching of the invention.

It will be understood that each of the elements described above, or two or more together, may also find a useful application in other types of fluid handling devices differing from the types described above.

While the invention has been illustrated and described as embodied in a control body arrangement for a fluid handling device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features which, from the standpoint of prior art, fairly constitute essential characteristics of the generic and specific aspects of this invention and, therefore, such adaptations should and and are intended to be comprehended within the meaning and range of equivalence of the claims.

What is claimed as new and desired to be protected by Letters Patent is set forth in the appended claims:

1. In a fluid handling device, a combination comprising a housing having inlet and outlet ports for admission and evacuation of fluid and pressure chamber means communicating with said ports; a rotor mounted in said housing and provided at one axial end thereof with a first control face having a gravity center, said rotor also having a plurality of working chambers and passages extending between said working chambers and said control face; and a control body axially movably received in said pressure chamber means of said housing and having a second control face adjacent to and defining with said first control face a narrow control clearance, said second control face having a geometrical center and another gravity center said control body being urged toward said rotor by said fluid in said pressure chamber means and including at least one larger-diameter first at least partially cylindrical portion coaxial with said rotor and at least one smaller-diameter second cylindrical portion which is eccentric relative to the axis of said rotor, the distance between the gravity center of said first control face and the axis of the rotor being substantially equal to the distance between said gravity center of said second cylindrical portion and the axis of said rotor.

2. A combination as defined in claim 1, wherein said second cylindrical portion projects in part radially beyond the circumferential outline of said first cylindrical portion.

3. A combination as defined in claim 1, wherein said pressure chamber means comprises a main chamber portion in which said first cylindrical portion is received, an eccentric chamber portion in which said second cylindrical portion is received, and wherein a crescent-shaped recess extends beyond said main chamber portion for enabling said part of said second cylindrical portion to move therethrough.

4. A combination as defined in claim 1, wherein said control body is formed with a medial recess which communicates with a low-pressure space of said device.

5. A combination as defined in claim 1, and further comprising an unloading channel connecting said medial recess with said low-pressure space.

6. A combination as defined in claim 1, wherein said pressure chamber means comprises a main pressure chamber portion, and an eccentric pressure chamber portion in which said first and second cylindrical portions are respectively received, said first cylindrical portion having freedom of movement in said main pressure chamber portion.

7. A combination as defined in claim 1, and further comprising means for limiting angular displacement of said control body in said pressure chamber means.

8. A combination as defined in claim 1, wherein said distance equals Gc, and wherein $$G_c = rg_c \times f_g$$

$$= \frac{\int_{\text{tau}}^{\text{pi}} r^2 dr}{180\ F} \times t_G$$

$$= \frac{360(r_o^3 - r_i^3)}{540(r_o^2 - r_i^2)} \times f_g \quad .$$

9. A combination as defined in claim 1, wherein said distance equals Gc, and wherein $$G_c = \frac{2(r_o^3 - r_{i\ hu}^{\ 3})}{3(r_o^2 - r_i^2)} \times (\sin \text{eta } 2 - \sin \text{eta } 1)/(\text{eta } 2 - \text{eta } 1)$$

with eta in grade x pi/180.

10. A combination as defined in claim 1, wherein the diameter of said second portion equals $$D = \sqrt{A_{HPmb} \cdot 4/\text{pi}}$$

* * * * *